US008317494B2

(12) United States Patent
Pileski et al.

(10) Patent No.: US 8,317,494 B2
(45) Date of Patent: Nov. 27, 2012

(54) COMPRESSOR TERMINAL PLATE

(75) Inventors: Peter J. Pileski, Manlius, NY (US); Bruce A. Fraser, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1027 days.

(21) Appl. No.: 11/814,994

(22) PCT Filed: Feb. 7, 2005

(86) PCT No.: PCT/US2005/003815
§ 371 (c)(1),
(2), (4) Date: Jul. 27, 2007

(87) PCT Pub. No.: WO2006/085864
PCT Pub. Date: Aug. 17, 2006

(65) Prior Publication Data

US 2008/0131303 A1 Jun. 5, 2008

(51) Int. Cl.
*F04B 17/03* (2006.01)
*H02K 11/00* (2006.01)

(52) U.S. Cl. ..... 417/410.5; 310/71

(58) Field of Classification Search ..... 417/410.5; 310/71
See application file for complete search history.

(56) References Cited

U.S. PATENT DOCUMENTS

| | | | | |
|---|---|---|---|---|
| 2,635,550 | A * | 4/1953 | Granberg | 417/234 |
| 2,781,463 | A * | 2/1957 | Sprando | 310/71 |
| 3,619,086 | A * | 11/1971 | Johnson et al. | 417/360 |
| 3,922,114 | A | 11/1975 | Hamilton et al. | |
| 4,193,657 | A | 3/1980 | Slone | |
| 4,903,497 | A * | 2/1990 | Zimmern et al. | 62/113 |
| 5,246,349 | A | 9/1993 | Hartog | |
| 5,385,453 | A * | 1/1995 | Fogt et al. | 417/410.5 |
| 5,961,293 | A | 10/1999 | Clemmons et al. | |
| 6,045,344 | A * | 4/2000 | Tsuboi et al. | 418/100 |
| 6,183,227 | B1 * | 2/2001 | Hida et al. | 418/55.6 |
| 6,241,489 | B1 * | 6/2001 | Lewin et al. | 417/410.1 |
| 6,364,645 | B1 * | 4/2002 | Dieterich | 418/86 |
| 6,485,274 | B2 | 11/2002 | Kosters | |
| 6,494,699 | B2 | 12/2002 | Sjoholm et al. | |
| 6,916,213 | B2 | 7/2005 | Nyblin et al. | |
| 7,687,945 | B2 * | 3/2010 | Matin et al. | 310/64 |
| 2003/0091446 | A1 | 5/2003 | Ikeda et al. | |
| 2003/0209948 | A1 * | 11/2003 | Blatter et al. | 310/71 |
| 2005/0111994 | A1 * | 5/2005 | Kimura et al. | 417/313 |

FOREIGN PATENT DOCUMENTS

| | | | |
|---|---|---|---|
| GB | 2381960 | A | 5/2003 |
| JP | 8210281 | A | 8/1996 |
| JP | 2004044606 | A | 2/2004 |

OTHER PUBLICATIONS

Australian Office Action for AU Patent Application No. 2005327257, dated Dec. 10, 2010.
European Office Action for EP Patent Application No. 05713017.1, dated Jun. 30, 2011.

* cited by examiner

*Primary Examiner* — Charles Freay
(74) *Attorney, Agent, or Firm* — Bachman & LaPointe, P.C.

(57) ABSTRACT

A compressor (20) has a housing (22) having first (52) and second (48) members. A motor (24) within the housing (22) is coupled to one or more working elements (26, 28) to drive the one or more working elements (26, 28) to compress a fluid. A number of electrical terminals (104) are each mounted in an associated aperture (132) in the second housing member (48) and electrically connected to the motor (24).

21 Claims, 4 Drawing Sheets

COMPRESSOR TERMINAL PLATE

BACKGROUND OF THE INVENTION

The invention relates to compressors. More particularly, the invention relates to hermetic refrigerant compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates.

Many such compressors are hermetic compressors wherein the motor is located within the compressor housing and may be exposed to a flow of refrigerant. Hermetic compressors present difficulties regarding their wiring. Routing of conductors through the housing while maintaining hermeticity and convenience of use while controlling manufacturing costs present difficulty. One exemplary configuration involves mounting electrical power terminals on a machined terminal plate. The terminal plate is, in turn, mounted over an opening in the compressor housing and sealed thereto.

SUMMARY OF THE INVENTION

According to one aspect of the invention, a compressor has a housing having first and second members. A motor within the housing is coupled to one or more working elements to drive the one or more working elements to compress a fluid. A number of electrical terminals are each mounted in an associated aperture in the second housing member and electrically coupled to the motor.

In various implementations, the compressor may be a hermetic screw compressor. The first housing member may be a motor case having a compressor inlet port. The second housing member may be a rotor case.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
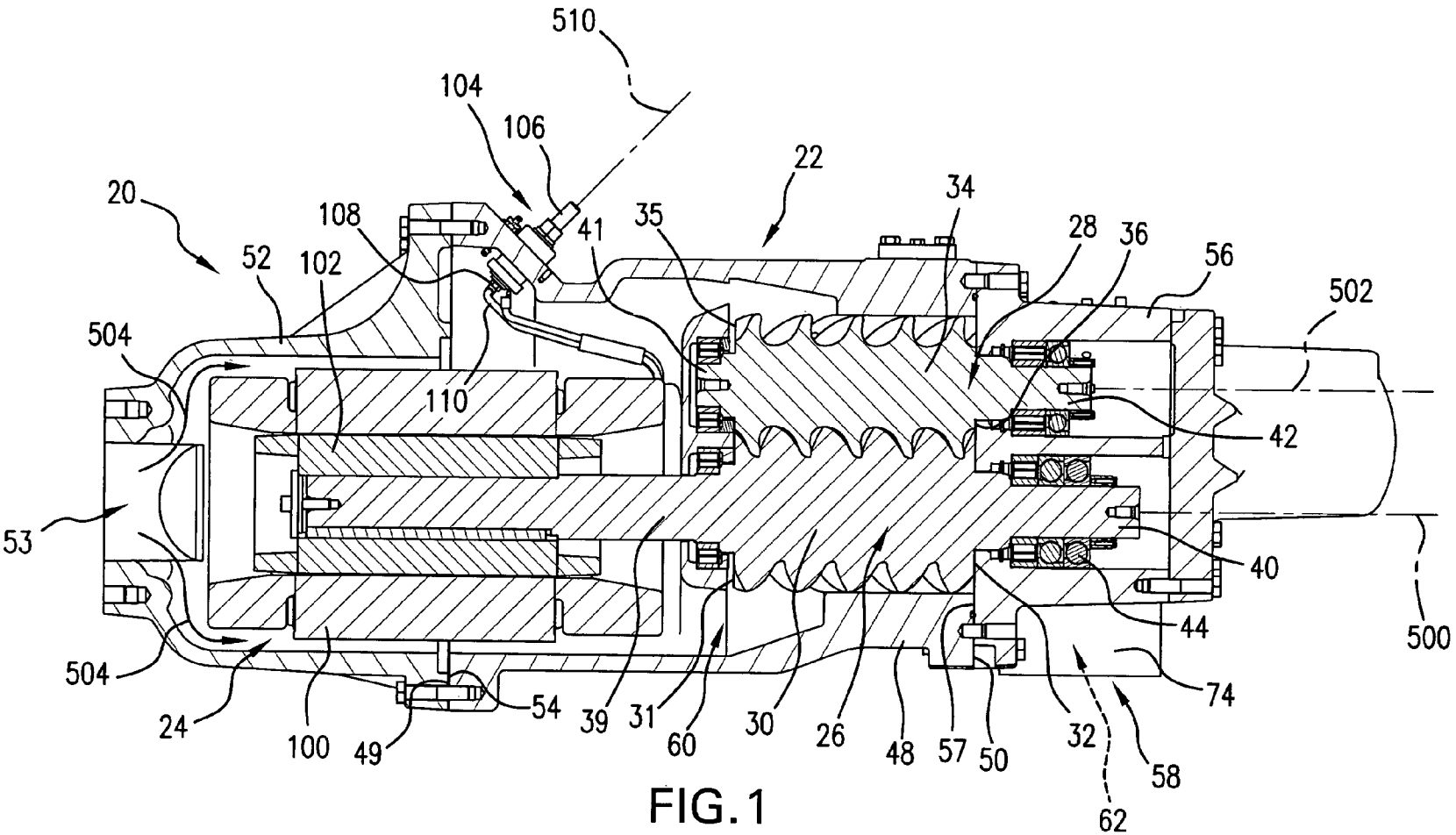
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (located below the cut plane and thus schematically indicated). A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

The exemplary compressor is a hermetic compressor wherein the motor 24 is sealed within the housing 22 and exposed to the refrigerant passing through the compressor. The motor 24 is coaxial with the rotor 26 along the axis 500 and has a stator 100 and a rotor 102. The rotor 102 is secured to an end portion of the shaft stub 39 to transmit rotation to the rotor 26. To supply power to the motor, electrical conductors must pass through the housing. These may include a number of terminals 104 mounted in the housing. Exemplary terminals have exterior pin-like contacts 106 having axes 510.

Figure 2:
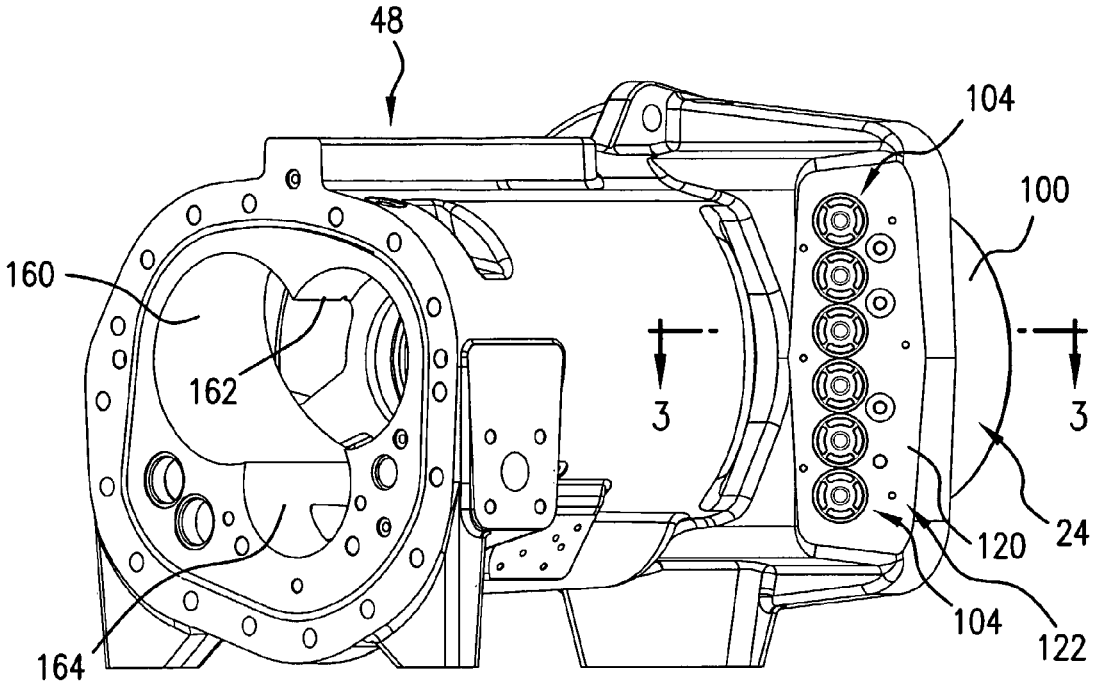
FIG. 2 is a view of a rotor case of the compressor of FIG. 1 carrying a motor and an electrical terminal array.

Exemplary terminals 104 have interior contacts 108 (e.g., screw fittings). For each terminal, a wire 110 extends from a first end at the contact 108 to a second end at the motor. For an exemplary three-phase motor, there are three pairs of such terminals (FIG. 2). FIG. 2 shows the terminals in an exemplary arrangement as a parallel linear array with outboard portions extending from a flat face (outer surface portion) 120 of an integral terminal plate 122 of the rotor case 48.

Figure 3:
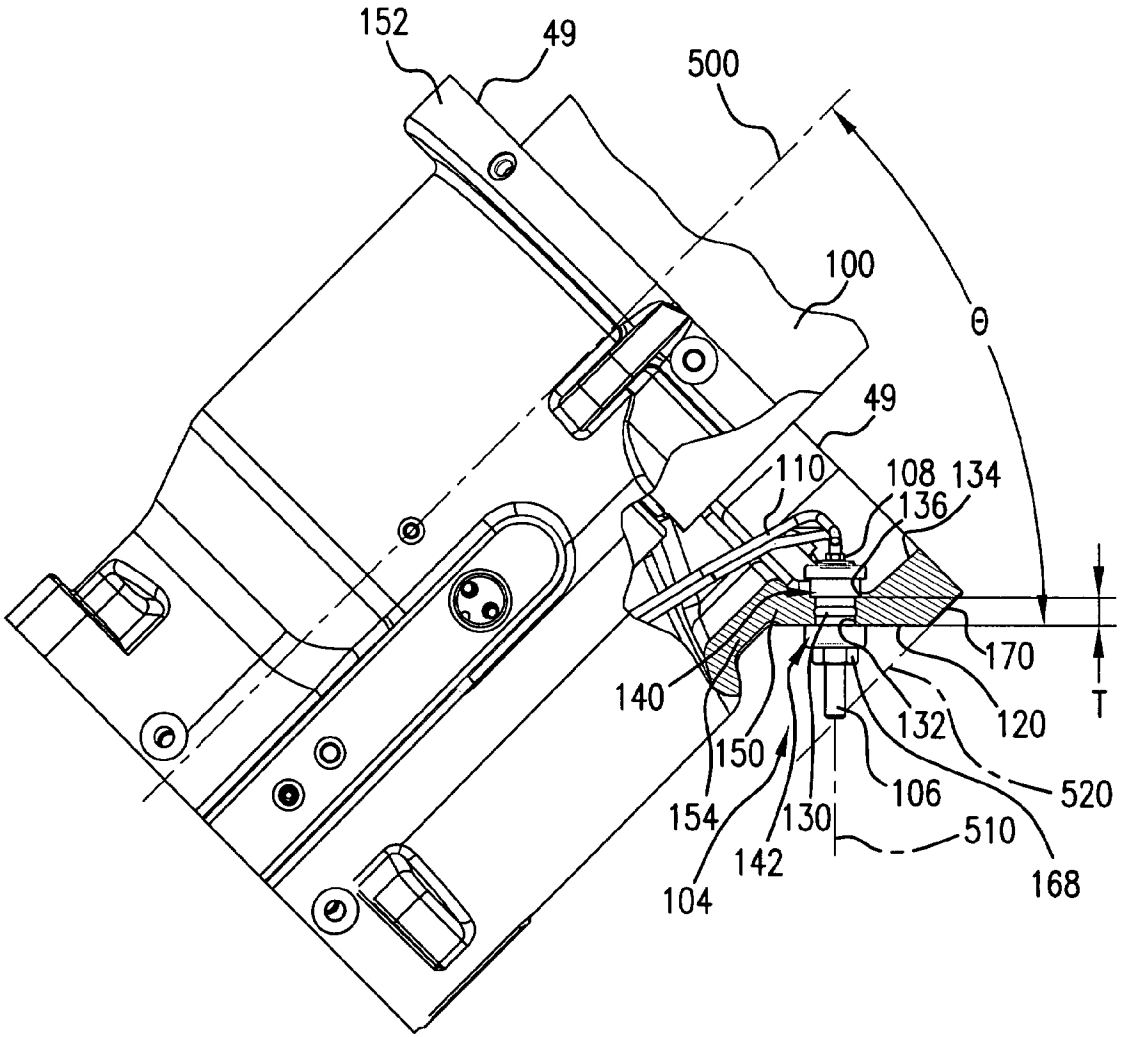
FIG. 3 is a top view of the case of FIG. 2, partially cutaway along line 3-3 of FIG. 2.
Figure 5:
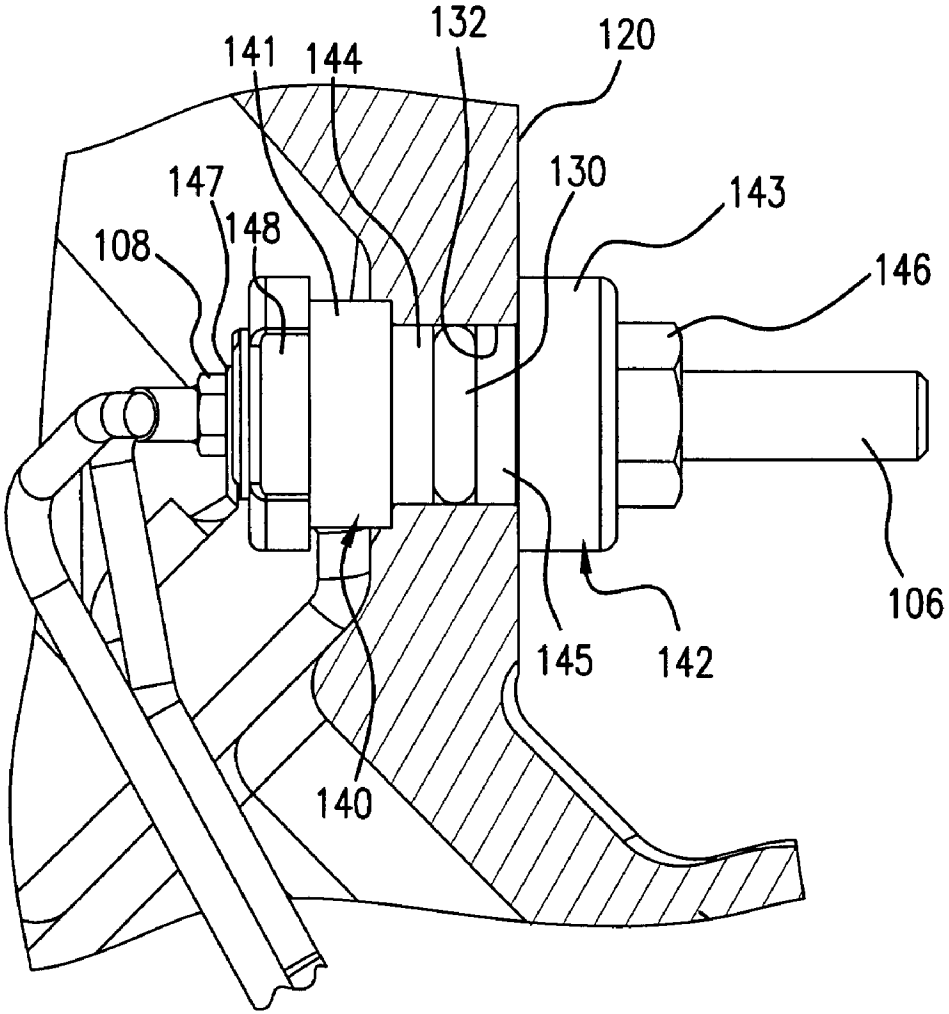
FIG. 5 is an enlarged view of the cutaway portion of FIG. 3.

FIG. 3 shows further details of the terminal mounting. Each terminal is sealed by an elastomeric O-ring 130 compressed within a bore 132 in the plate 122. Along the housing interior surface 134 there is a counterbore 136. An interior insulator 140 has a main portion 141 (FIG. 5) accommodated in the counterbore 136. An exterior insulator 142 has a main body 143 atop the face 120. The insulators 140 and 142 have respective insertion portions 144 and 145 within the bore 133 and having distal end faces sandwiching and compressively engaging the O-ring 130. Compression is maintained by a nut 146 threaded to the pin 106 and bearing against the insulator body 143. A head 147 of the pin may be faceted and captured by a head 148 of the insulator 140 and may receive the screw contact 108.

In the exemplary embodiment, the face 120 and plate 122 fall along a local shoulder 150 (FIG. 3) between a flange 152 and a local recessed area 154. The flange 152 acts as a mounting flange along the surface 49 and receives bolts 154 (FIG. 1) securing the motor case 52 to the rotor case 48. Along the terminal plate 122, the shoulder is off-longitudinal by an angle θ. Thus, the axis 510 is off-longitudinal by θ's complement. Exemplary θ is 45°, more broadly 30-60°. This angling facilitates a number of advantages. It permits ease in forming the rotor housing by casting. The rotor housing precursor may be cast (e.g., of iron or aluminum) and subject to further machining. The machining may include machining of the rotor bores 160 and 162 and the slide valve bore 164. The machining may include forming various mounting holes and fluid communication passageways. The machining may include machining of the face 120 for precise planarity. The machining may include machining the bores 132 through the face 120 of the terminal plate 122.

Figure 4:
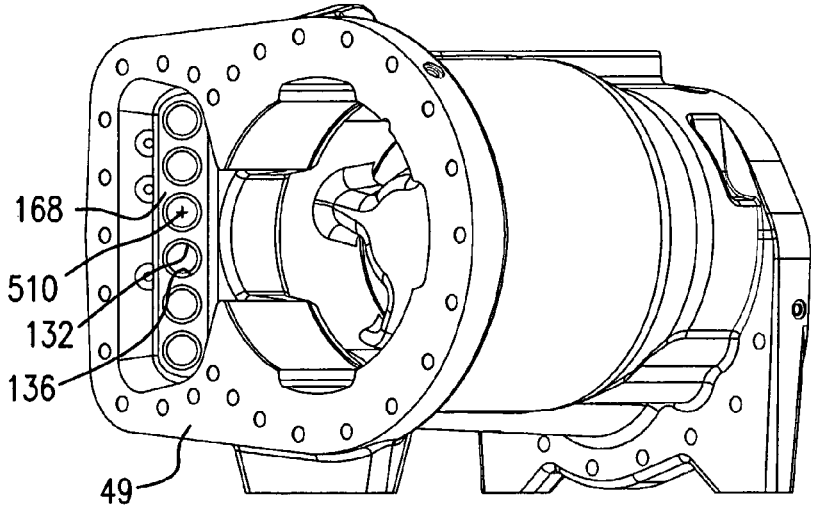
FIG. 4 is a suction end view of the case of FIG. 2.

However, for the terminals, the machining includes machining of the counterbores 136 (FIG. 4) with a tool inserted through the open upstream/suction side end (either before or after machining the face 49 thereon). The machining may also include machining a flat plateau surface 168 surrounding the group of bores 132 and counterbores 136 (e.g., before machining at least the counterbores). The angling helps provide clearance for the tools doing the internal machining. As viewed in FIG. 4, clearance is relative to a portion of the mounting flange to the left and upper and lower wall segments of a stator bore to the right, both extending to the face 49. The stator bore retains a downstream portion of the stator to ensure coaxiality with the rotor 26. The counterboring provides a counterbore base surface at a precise and consistent separation T from the face 120. This permits precise positioning of the terminals. This also avoids sealing problems associated with mounting the terminals in a plate separate from the casting and which must be sealed thereto by additional means. The angling may provide additional use benefits. For example, as shown in FIG. 3, a major portion of the exposed pin lies inboard of the projection 520 of the perimeter 170 of the flange 152. This may help reduce chances of damage to the pins.

The precision of the thickness T may provide additional assembly ease benefits. A precise amount of compression of the O-ring 130 is required to provide an effective seal. Typically this precision could be obtained by precise torquing. However, with a precise thickness T and precise lengths of the insulator insertion portions 144 and 145 less torque precision is needed. These dimensions may be chosen to provide the desired degree of O-ring compression when the underside (shoulder) of the insulator body 143 is flat against the face 120 and the underside of the body 141 is bottomed against the base of the counterbore. This eases assembly and reduces risk of damage to the O-ring from overtorquing.

An additional assembly benefit may come from radial enlargement and faceting of the heads 148. The spacing between bores and the size of the heads 148 is chosen so that each head 148 interfits with the next so that more than a slight rotation of the head 148 brings it into interference with the adjacent head(s) 148 to prevent more than limited rotation. The antirotation engagement of the pin head 147 to the insulator head 148 thus holds the pin against more than this limited rotation. Thus, to tighten the nuts 146 no separate tool is necessarily required to hold the head of the pin.

One or more embodiments of the present invention have been described. Nevertheless, it will be understood that various modifications may be made without departing from the spirit and scope of the invention. For example, in a reengineering, details of the existing compressor configuration may particularly influence or dictate details of the implementation. Accordingly, other embodiments are within the scope of the following claims.

What is claimed is:

1. A compressor apparatus comprising:

a housing having first and second ports along a flow path, the housing being an assembly of at least:

a first housing member having first and second ends; and a second housing member being a casting having first and second ends, the second housing member first end being secured to the first housing member second end; two or more working elements cooperating with the housing to define a compression path between suction and discharge locations along the flow path, wherein the two or more working elements include:

a male-lobed rotor having a first rotational axis; and a female-lobed rotor having a second rotational axis and enmeshed with the male-lobed rotor, the lobed portions of the rotors being at least partially within the second housing member;

a motor within the housing and coupled to the two or more working elements to drive the two or more working elements; and a plurality of electrical terminals, each mounted directly in a separate associated aperture in the casting and electrically coupled to the motor.

2. The apparatus of claim 1 wherein:

the first port is an inlet port in the first housing member; and the motor is at least partially within the first housing member.

3. The apparatus of claim 2 wherein:

a third housing member has a first end secured to the second housing member second end;

the second port is an outlet port in the third housing member; and the motor is mostly within the first housing member.

4. The apparatus of claim 1 wherein:

there are at least six terminals oriented in a single direction.

5. The apparatus of claim 4 wherein:

said single direction is 30-60° off normal to an axial direction of the motor.

6. The apparatus of claim 5 wherein:

the motor is exposed to a flow along the flowpath.

7. The apparatus of claim 1 further comprising:
wiring coupling the terminals to the motor.
8. The apparatus of claim 7 wherein:
each of the terminals comprises an external contact for engaging external wiring.
9. The apparatus of claim 7 wherein:
the terminals are in a linear array.
10. The apparatus of claim 1 wherein
each of the terminals comprises an external contact for engaging external wiring; and
the external contacts are mostly inboard of a mounting flange at the second housing member first end.
11. The apparatus of claim 1 wherein:
at least one of the rotors is coaxial with the motor; and
said lobed portions of the rotors are essentially entirely within the second housing member.
12. The apparatus of claim 1 wherein:
the motor is a three-phase electric motor; and
there are six such terminals.
13. The apparatus of claim 1 wherein:
each aperture comprises a bore and a counterbore, the counterbore on an interior surface of the second housing member.
14. A method for manufacturing the compressor apparatus of claim 1, the method comprising:
casting a precursor of the second housing member;
machining a first mounting surface at the first end of the second housing member;
forming said apertures by:
boring a plurality of bores; and
counterboring the bores at an interior of the second housing member, the counterboring being off axial by an angle of 30-60';
boring at least a pair of axial rotor bores in the second housing member;
boring a slide valve bore in the second housing member;
assembling the male-lobed rotor and the female-lobed rotor to the second housing member in the pair of rotor bores;
assembling a slide valve to the second housing member in the slide valve bore;
coupling the motor to a first of the male-lobed rotor and the female-lobed rotor; and
assembling the first housing member to the second housing member.
15. The method of claim 14 wherein:
the counterboring is performed by a tool extending through the first end of the second housing member.
16. The method of claim 15 wherein:
the counterboring is performed after the machining.
17. The apparatus of claim 4 wherein:
the first port is an inlet port in the first housing member; and
the motor is at least partially within the first housing member.
18. The apparatus of claim 17 wherein:
a third housing member has a first end secured to the second housing member second end;
the second port is an outlet port in the third housing member; and
the motor is mostly within the first housing member.
19. A compressor apparatus comprising:
a housing having first and second ports along a flow path, the housing being an assembly of at least:
a first housing member having first and second ends; and
a second housing member, having first and second ends, the second housing member first end being secured to the first housing member second end;
one or more working elements cooperating with the housing to define a compression path between suction and discharge locations along the flow path;
a motor within the housing and coupled to the one or more working elements to drive the one or more working elements; and
a plurality of electrical terminals, each mounted directly in an associated aperture in the second housing member and electrically coupled to the motor, at least six said terminals oriented in a single direction 30-60° off normal to an axial direction of the motor.
20. The apparatus of claim 19 wherein:
the second housing member is a casting and the apertures are in said casting.
21. A compressor apparatus comprising:
a housing having first and second ports along a flow path, the housing being an assembly of at least:
a first housing member having first and second ends; and
a second housing member, having first and second ends, the second housing member first end being secured to the first housing member second end;
one or more working elements cooperating with the housing to define a compression path between suction and discharge locations along the flow path;
a motor at least partially within the first housing member and coupled to the one or more working elements to drive the one or more working elements; and
a plurality of electrical terminals, each mounted directly in a separate associated aperture in the second housing member and electrically coupled to the motor, wherein:
each of the terminals comprises an external contact for engaging external wiring; and
the external contacts are mostly inboard of a mounting flange at the second housing member first end.

* * * * *